US009422819B2

(12) United States Patent
Drozdenko et al.

(10) Patent No.: US 9,422,819 B2
(45) Date of Patent: Aug. 23, 2016

(54) ROTOR BLADE ROOT SPACER FOR ARRANGING BETWEEN A ROTOR DISK AND A ROOT OF A ROTOR BLADE

(71) Applicant: United Technologies Corporation, Hartford, CT (US)

(72) Inventors: Lee Drozdenko, Bristol, CT (US); William R. Graves, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 1052 days.

(21) Appl. No.: 13/718,776

(22) Filed: Dec. 18, 2012

(65) Prior Publication Data

US 2014/0169976 A1 Jun. 19, 2014

(51) Int. Cl.
*F01D 5/30* (2006.01)

(52) U.S. Cl.
CPC ..... *F01D 5/3092* (2013.01); *F01D 5/3007* (2013.01); *F05D 2220/36* (2013.01)

(58) Field of Classification Search
CPC ..... F01D 5/30; F01D 5/3007; F01D 5/3092; F01D 5/326
See application file for complete search history.

(56) References Cited

U.S. PATENT DOCUMENTS 3,216,699 A * 11/1965 Schoenborn ..... F01D 5/22 416/190
5,080,556 A 1/1992 Carreno
5,123,813 A * 6/1992 Przytulski ..... F01D 5/26 403/372
5,240,375 A 8/1993 Wayte
6,481,971 B1 11/2002 Forrester
6,582,195 B2 6/2003 Davidson
6,846,159 B2 1/2005 Zabawa et al.
7,458,780 B2 12/2008 Weisse et al.
7,993,105 B2 8/2011 Weisse et al.
8,167,566 B2 5/2012 Howes
2004/0076523 A1 4/2004 Sinha et al.
2005/0254951 A1* 11/2005 Thenaisie ..... F01D 5/323 416/219 R
2007/0048140 A1 3/2007 Farr et al.
2009/0004017 A1* 1/2009 Belmonte ..... F01D 5/3092 416/219 R
2009/0060745 A1 3/2009 Douguet et al.
2011/0150657 A1 6/2011 Millier et al.
2011/0211965 A1 9/2011 Deal et al.
2011/0211967 A1 9/2011 Deal et al.
2011/0305576 A1 12/2011 Ward et al.
2012/0107125 A1* 5/2012 Reghezza ..... F01D 5/3007 416/220 R
2012/0301292 A1 11/2012 Deal et al.

OTHER PUBLICATIONS

International search report for PCT/US2013/076171 dated Apr. 7, 2014.
International search report for PCT/US2013/076147 dated Apr. 9, 2014.

* cited by examiner

*Primary Examiner* — Nathaniel Wiehe
*Assistant Examiner* — Woody A Lee, Jr.
(74) *Attorney, Agent, or Firm* — O'Shea Getz P.C.

(57) ABSTRACT

A rotor assembly is provided that includes a rotor blade, a root spacer, and a rotor disk with a slot. The rotor blade includes a blade root arranged within the slot. The blade root includes a root base segment and a pair of root side segments. The root base segment is laterally separated from the rotor disk by the root side segments. The root spacer is arranged within the slot, and includes a side surface that extends radially between an inner surface and an outer surface. The side surface is approximately laterally aligned with an intersection between the root base segment and a first of the root side segments. The outer surface engages the root base segment.

13 Claims, 6 Drawing Sheets

ROTOR BLADE ROOT SPACER FOR ARRANGING BETWEEN A ROTOR DISK AND A ROOT OF A ROTOR BLADE

CROSS-REFERENCE TO RELATED APPLICATIONS

This application is related to U.S. patent application Ser. No. 13/718,719 filed Dec. 18, 2012, which is hereby incorporated herein by reference in its entirety.

BACKGROUND OF THE INVENTION

1. Technical Field

This disclosure relates generally to rotational equipment and, more particularly, to a root spacer for arranging between a rotor disk and a root of a rotor blade.

2. Background Information

A fan assembly for a typical turbine engine includes a plurality of fan blades arranged circumferentially around a rotor disk. Each of the fan blades may include an airfoil connected to a dovetail root. The root is inserted into a respective dovetail slot within the rotor disk to connect the fan blade to the rotor disk. A radial height of the root is typically less than a radial height of the slot. A gap therefore extends between a radial inner surface of the root and a radial inner surface of the slot. Such a gap is typically filled with a root spacer, which is sometimes also referred to as a fan blade spacer.

A typical root spacer is configured to reduce slippage and wear between the root and the rotor disk during engine operation where centrifugal loading on the fan blade is relatively low; e.g., during wind milling. By filling the gap, for example, the root spacer reduces space that would otherwise be available for rotating of the root within the slot. Such a rigid connection between the rotor disk and the fan blade, however, may increase internal stresses on the fan blade where an object such as a bird or a released fan blade collides with the fan blade.

There is a need in the art for an improved rotor spacer.

SUMMARY OF THE DISCLOSURE

According to an aspect of the invention, a rotor assembly is provided that includes a rotor disk, a rotor blade, and a root spacer. The rotor disk includes a slot. The rotor blade includes a blade root arranged within the slot. The blade root includes a root base segment and a pair of root side segments. The root base segment is laterally separated from the rotor disk by the root side segments. The root spacer is arranged within the slot, and includes a side surface that extends radially between an inner surface and an outer surface. The side surface is approximately laterally aligned with an intersection between the root base segment and a first of the root side segments. The outer surface engages the root base segment.

According to another aspect of the invention, another rotor assembly is provided that includes a rotor disk, a rotor blade and a root spacer. The rotor disk includes a slot. The rotor blade includes a blade root arranged within the slot. The blade root includes a root base segment and a pair of root side segments. The root side segments extend laterally between and laterally separate the root base segment and the rotor disk. The root spacer is arranged within the slot. The root spacer includes a side surface that extends radially between an inner surface and an outer surface that engages the root base segment. A gap, located adjacent the side surface, extends radially between a first of the root side segments and the rotor disk.

According to still another aspect of the invention, a turbine engine is provided that includes a fan section, a compressor section, a combustor section and a turbine section that are arranged along an axis. The fan section includes a rotor disk, a fan blade and a root spacer. The rotor disk includes a slot. The fan blade includes a blade root arranged within the slot. The blade root includes a root base segment and a pair of root side segments, where the root base segment is laterally separated from the rotor disk by the root side segments. The root spacer is arranged within the slot, and includes a side surface that extends radially between an inner surface and an outer surface. The side surface is approximately laterally aligned with an intersection between the root base segment and a first of the root side segments. The outer surface engages the root base segment.

A gap, located adjacent the side surface, may extend radially between the first of the root side segments and the rotor disk.

The side surface may be configured as a first side surface, and the root spacer may include a second side surface that extends radially between the inner surface and the outer surface. The second side surface may be approximately laterally aligned with an intersection between the root base segment and a second of the root side segments. The outer surface may have a substantially flat cross-sectional geometry. The slot may extend radially into the rotor disk from an opening with a first lateral width. The root spacer may have a second lateral width that extends between the first and the second side surfaces. The second lateral width may be between about 80 and about 110 percent of the first lateral width.

The root spacer may include a spacer base segment and a spacer side segment. The spacer base segment may be arranged radially between the root base segment and the rotor disk. The spacer side segment may be arranged radially between a second of the root side segments and the rotor disk. The spacer base segment may include a portion of the outer surface having a substantially flat cross-sectional geometry. The slot may extend radially into the rotor disk from an opening with a first lateral width. The portion of the outer surface may have a second lateral width. The second lateral width may be between about 80 and about 110 percent of the first lateral width.

The rotor blade may be configured as a turbine engine fan blade.

The slot may be one of a plurality of slots that extend longitudinally into the rotor disk. The rotor blade may be one of a plurality of rotor blades that are arranged circumferentially around an axis, where each of the rotor blades includes a respective blade root that is arranged within a respective one of the slots. The root spacer may be one of a plurality of root spacers, where each of the root spacers is arranged within a respective one of the slots between the rotor disk and a respective one of the blade roots.

The side surface may be approximately laterally aligned with an intersection between the root base segment and the first of the root side segments.

The side surface may be configured as a first side surface, and the root spacer may include a second side surface that extends radially between the inner surface and the outer surface. A gap, located adjacent the second side surface, may extend radially between a second of the root side segments and the rotor disk. The outer surface may have a substantially flat cross-sectional geometry. The slot may extend radially into the rotor disk from an opening with a first lateral width. The root spacer may have a second lateral width that extends between the first and the second side surfaces. The second lateral width may be between about 80 and about 110 percent of the first lateral width.

The foregoing features and the operation of the invention will become more apparent in light of the following description and the accompanying drawings.

DETAILED DESCRIPTION OF THE INVENTION

Figure 1:
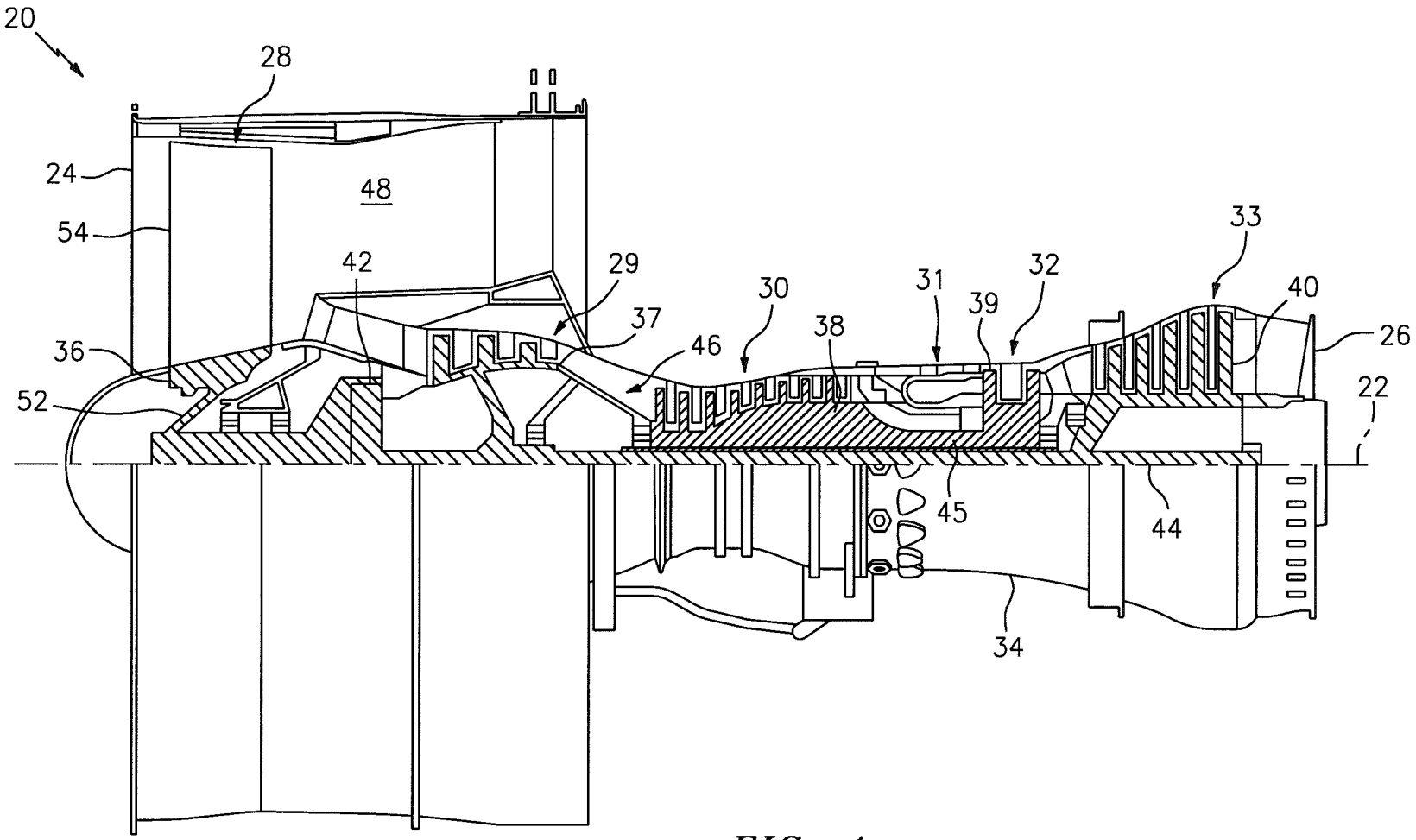
FIG. 1 is a side sectional illustration of a geared turbine engine.

FIG. 1 is a sectional illustration of a geared turbine engine 20 that extends along an axis 22 between a forward airflow inlet 24 and an aft airflow exhaust 26. The engine 20 includes a fan section 28, a low pressure compressor (LPC) section 29, a high pressure compressor (HPC) section 30, a combustor section 31, a high pressure turbine (HPT) section 32, and a low pressure turbine (LPT) section 33. These engine sections 28-33 are arranged sequentially along the axis 22 and housed within an engine case 34. Each of the engine sections 28-30, 32 and 33 includes a respective rotor 36-40. Each of the rotors 36-40 includes a plurality of rotor blades arranged circumferentially around and connected (e.g., mechanically fastened, welded, brazed or otherwise adhered) to one or more respective rotor disks. The fan rotor 36 is connected to a gear train 42. The gear train 42 and the LPC rotor 37 are connected to and driven by the LPT rotor 40 through a low speed shaft 44. The HPC rotor 38 is connected to and driven by the HPT rotor 39 through a high speed shaft 45.

Air enters the engine 20 through the airflow inlet 24, and is directed through the fan section 28 and into an annular core gas path 46 and an annular bypass gas path 48. The air within the core gas path 46 may be referred to as "core air". The air within the bypass gas path 48 may be referred to as "bypass air" or "cooling air". The core air is directed through the engine sections 29-33 and exits the engine 20 through the airflow exhaust 26. Within the combustion section 31, fuel is injected into and mixed with the core air and ignited to provide forward engine thrust. The bypass air is directed through the bypass gas path 48 and out of the engine 20 to provide additional forward engine thrust or reverse thrust via a thrust reverser. The bypass air may also be utilized to cool various turbine engine components within one or more of the engine sections 29-33.

Figure 2:
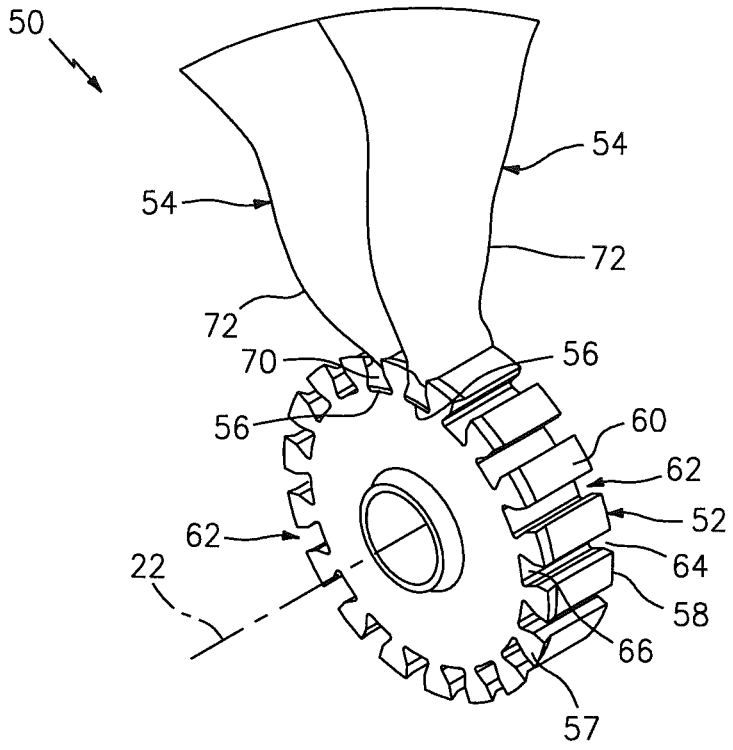
FIG. 2 is a perspective illustration of a partially assembled rotor assembly for the turbine engine of FIG. 1.

FIG. 2 is a perspective illustration of a partially assembled rotor assembly 50 for one of the rotors 36-40 (e.g., the fan rotor 36). In the embodiment of FIG. 2, the rotor assembly 50 includes the rotor disk 52, the rotor blades 54 (e.g., fan blades), and one or more root spacers 56 (e.g., fan blade spacers).

Figure 3:
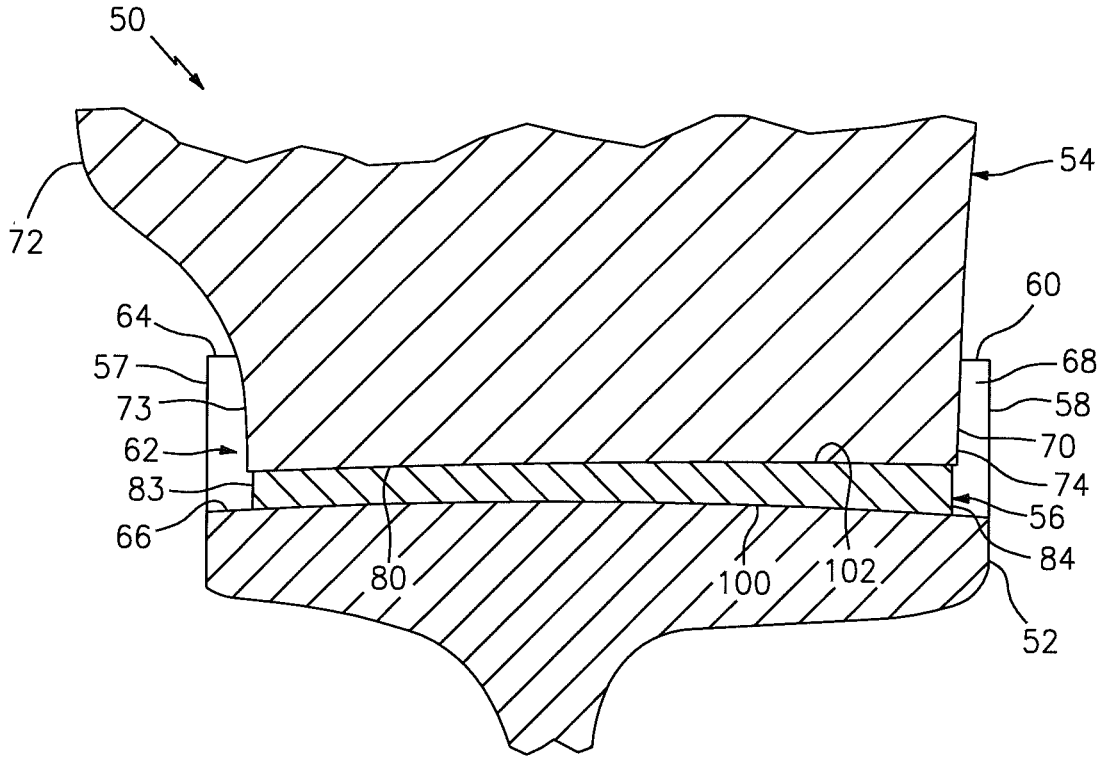
FIG. 3 is a side sectional illustration of a portion of the rotor assembly of FIG. 2.
Figure 4:
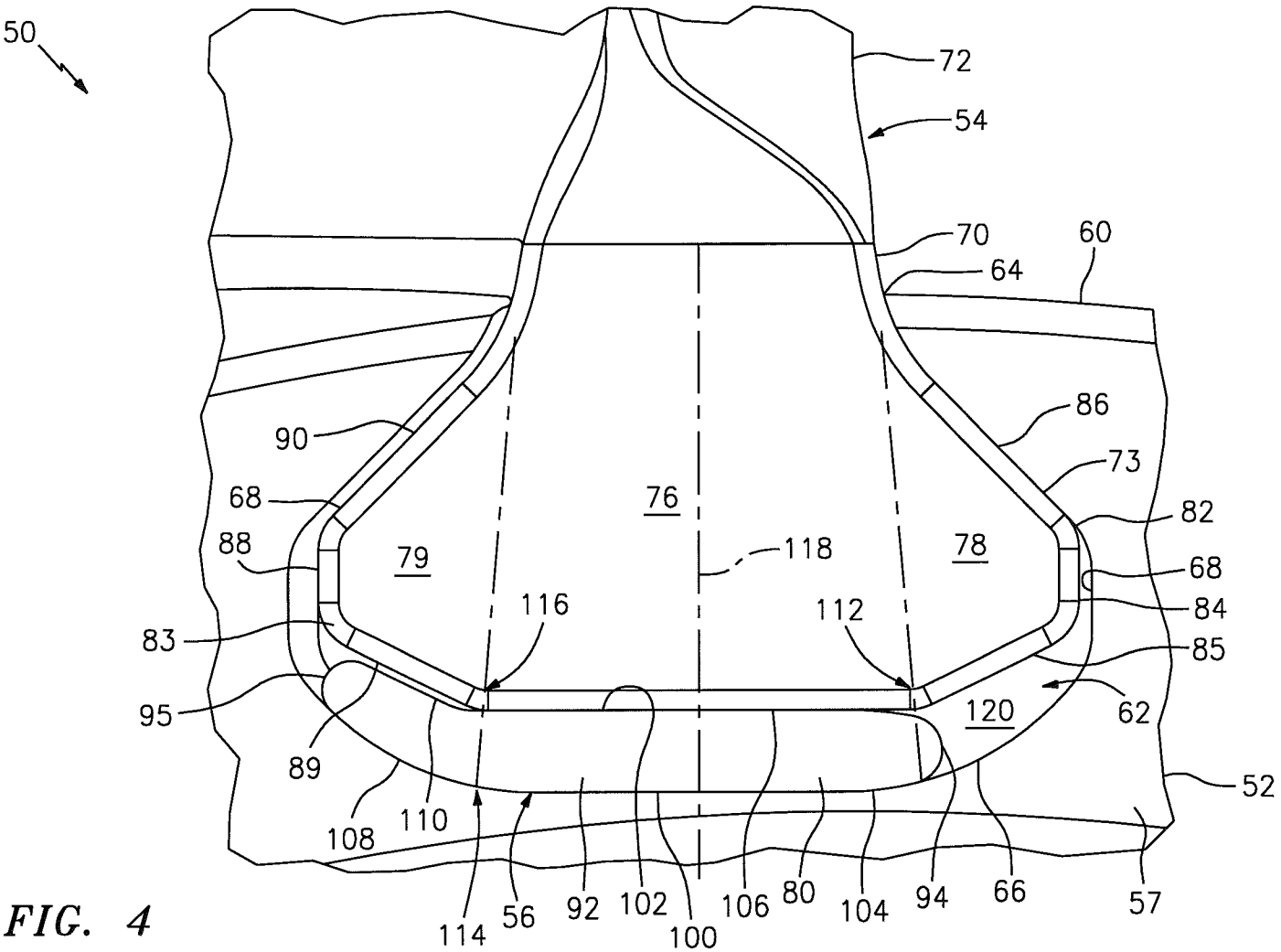
FIG. 4 is a perspective illustration of an end of a portion of the rotor assembly of FIG. 2 during a first mode of operation.

The rotor disk 52 extends axially between a disk forward end 57 and a disk aft end 58. The rotor disk 52 extends radially out to a disk outer surface 60. The rotor disk 52 includes one or more slots 62 (e.g., dovetail slots) arranged circumferentially around the axis 22. Referring to FIG. 3, one or more of the slots 62 each extends longitudinally into the rotor disk 52; e.g., through the rotor disk 52 between the forward end 57 and the aft end 58. Referring now to FIG. 4, one or more of the slots 62 each extends radially into the rotor disk 52 from an opening 64 in the outer surface 60 to a slot base surface 66. One or more of the slots 62 each extends laterally (e.g., circumferentially or tangentially) between opposing slot side surfaces 68. The base surface 66 extends laterally between the side surfaces 68.

Referring to FIG. 3, one or more of the rotor blades 54 each includes a blade root 70 and an airfoil 72. The blade root 70 extends longitudinally between a root forward end 73 and a root aft end 74. Referring to FIG. 4, the blade root 70 includes a root base segment 76 and a pair of root side segments 78 and 79. The base segment 76 extends radially between the airfoil 72 and a root base surface 80. The side segments 78 and 79 respectively extend laterally from the base segment 76 to opposing root side surfaces 82 and 83. The base surface 80 extends laterally between the side surfaces 82 and 83, and may have a substantially flat cross-sectional geometry. The side surface 82 includes an intermediate portion 84 that extends radially between inner and outer portions 85 and 86. The inner portion 85 extends laterally between the base surface 80 and the intermediate portion 84. The inner portion 85 may have a substantially flat cross-sectional geometry that is angularly offset from the base surface 80 by, for example, between about 135 and about 160 degrees. The side surface 83 includes an intermediate portion 88 that extends radially between inner and outer portions 89 and 90. The inner portion 89 extends laterally between the base surface 80 and the intermediate portion 88. The inner portion 89 may have a substantially flat cross-sectional geometry that is angularly offset from the base surface 80 by, for example, between about 135 and about 160 degrees.

Figure 5:
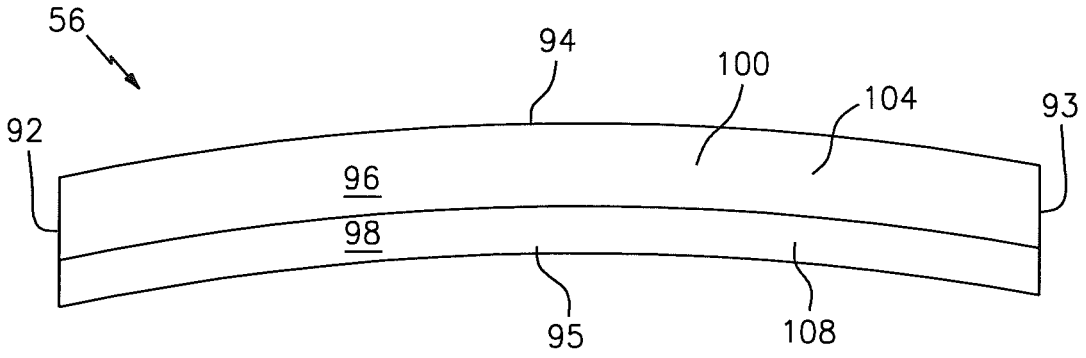
FIG. 5 is an illustration of an inner surface of a root spacer for the rotor assembly of FIG. 2.

Referring to FIGS. 4 and 5, one or more of the root spacers 56 each extends longitudinally between a spacer forward end 92 and a spacer aft end 93. One or more of the root spacers 56 extends laterally between opposing spacer side surfaces 94 and 95. One or more of the root spacers 56 includes a spacer base segment 96 and a spacer side segment 98. These segments 96 and 98 extend radially between a spacer inner surface 100 and a spacer outer surface 102, which surfaces 100 and 102 extend laterally between the side surfaces 94 and 95. The base segment 96 extends laterally between the side surface 94 and the side segment 98, and respectively defines base portions 104 and 106 of the inner and the outer surfaces 100 and 102. The base portion 106 may have a substantially flat cross-sectional geometry, and a lateral width that is substantially equal to (or is between about 80 and about 110 percent of) a lateral width of the opening 64. The side segment 98 extends laterally between the side surface 95 and the base segment 96. The side segment 98 defines side portions 108 and 110 of the inner and the outer surfaces 100 and 102. The side portion 110 may have a substantially flat cross-sectional geometry that is angularly offset from the base portion 106 by, for example, between about 135 and about 160 degrees.

Referring to FIG. 2, the rotor blades 54 are arranged circumferentially around the axis 22. The blade roots 70 and the root spacers 56 are respectively arranged within the slots 62. Referring to FIG. 4, the root side segments 78 and 79 respectively extend laterally between and separate the root base segment 76 and the rotor disk 52. The outer portions 86 and 90 may respectively engage (e.g., contact) the slot side surfaces 68. The root spacer 56 is arranged radially between the blade root 70 and the rotor disk 52. The spacer side surface 94 is approximately laterally aligned with (e.g., laterally on, adjacent or proximate) an intersection 112 between the root base segment 76 and the root side segment 78. An intersection 114 between the spacer base segment 96 and the spacer side segment 98 is approximately laterally aligned with an intersection 116 between the root base segment 76 and the root side segment 79. This intersection 114 is also laterally offset from a lateral centroid 118 of the blade root 70 by a lateral distance. The side portion 110 engages the inner portion 89. The base portion 106 engages the root base surface 80. The base and side portions 104 and 108 may engage the slot base surface 66. A gap 120, located adjacent the spacer side surface 94, extends radially between and separates the inner portion 85 and the slot base surface 66.

Figure 6:
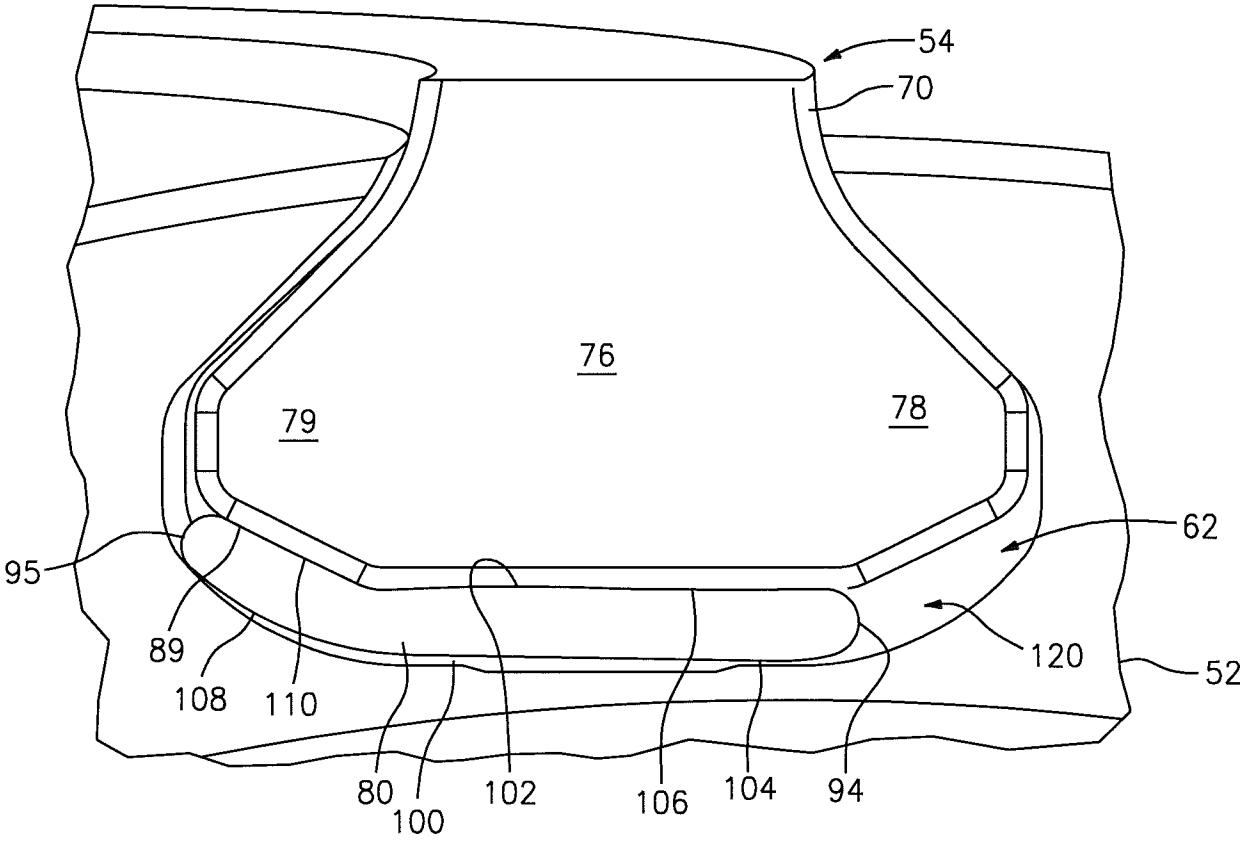
FIG. 6 is a perspective illustration of an end of a portion of the rotor assembly of FIG. 2 during a second mode of operation.

FIG. 4 illustrates an end of a portion of the rotor assembly 50 during a first mode of operation; e.g., during nominal flight conditions. FIG. 6 illustrates an end of a portion of the rotor assembly 50 during a second mode of operation; e.g., during non-nominal flight conditions such as after a foreign object collides with one or more of the rotor blades 54. During the first mode of operation of FIG. 4, the spacer side segment 98 may substantially prevent the blade root 70 from rotating within the slot 62 by radially supporting the root side segment 79 and/or substantially filling the radial space within the slot 62 between the blade root 70 and the rotor disk 52. In contrast, during the second mode of operation of FIG. 6, a shock load generated by the collision of the foreign object against the rotor blades 54 causes the blade root 70 to shift the root spacer 56 towards the left-hand side of the page. The blade root 70 therefore may rotate clockwise within the slot 62 by pivoting about a corner between the spacer outer and side surfaces 94 and 102. This rotating of the blade root 70 may enable the rotor blade 54 to substantially absorb the shock load without breaking and causing additional harm to the engine 20.

Figure 7:
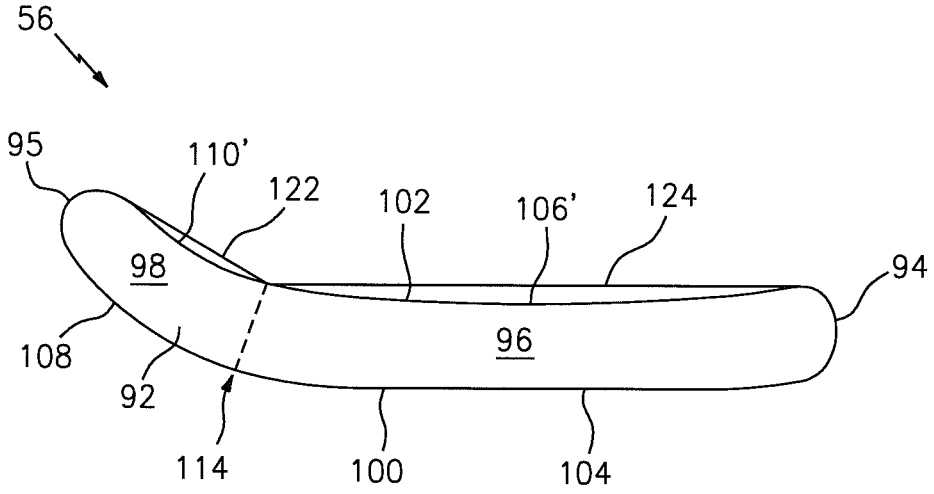
FIG. 7 is an illustration of an end of an alternative embodiment root spacer for the rotor assembly of FIG. 2.
Figure 8:
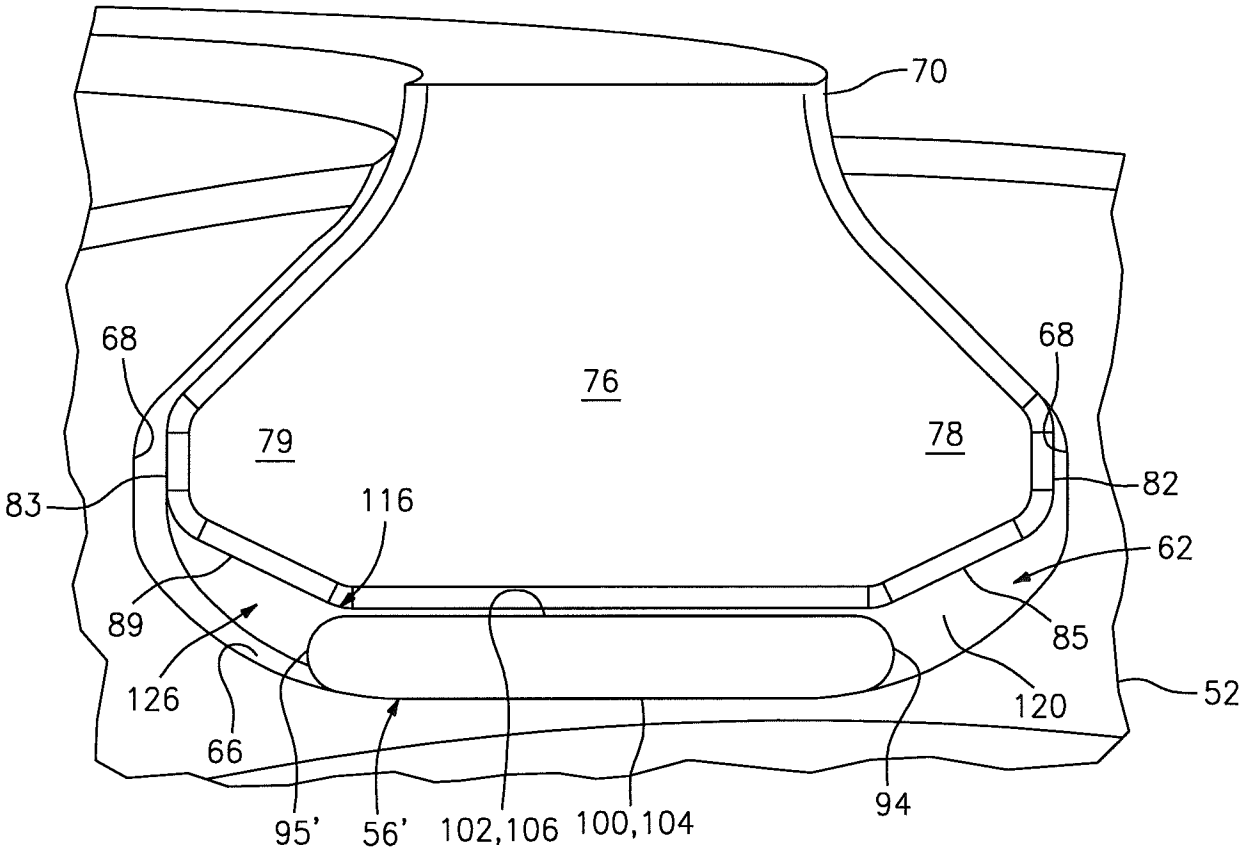
FIG. 8 is a perspective illustration of an end of a portion of the rotor assembly of FIG. 2 with an alternative embodiment root spacer.

One or more of the root spacers 56 may have various configurations other than those described above. For example, as illustrated in FIG. 7, the base and/or side portions 106' and 110' may each have a curved cross-sectional geometry. In the embodiment of FIG. 7, the side portion 110' has a chord 122 that is angularly offset from a chord 124 of the base portion 106'. In addition or alternatively, for example as illustrated in FIG. 8, one or more of the root spacers 56' may omit the spacer side segment 98 (see FIG. 4). The spacer base segment 96' and the base portions 104 and 106 therefore extend laterally between the spacer side surfaces 94 and 95'. The spacer side surface 95' is approximately laterally aligned with the intersection 116 between the root base segment 76 and the root side segment 79. A gap 126, located adjacent the spacer side surface 95', extends radially between and separates the inner portion 89 and the slot base surface 66. The present invention therefore is not limited to any particular root spacer configurations.

The root spacers 56 may be constructed from a variety of materials such as metal and/or polymer. The present invention therefore is not limited to any particular root spacer materials.

The terms "upstream", "downstream", "inner" and "outer" are used to orientate the components of the rotor assembly 50 described above relative to the turbine engine 20 and its axis 22. A person of skill in the art will recognize, however, the rotor assembly components such as the root spacer 56 may be utilized in other orientations than those described above. The spacer side segment, for example, may be arranged radially between the root side segment 78 and the rotor disk. The present invention therefore is not limited to any particular rotor assembly or root spacer spatial orientations.

A person of skill in the art will recognize the rotor assembly 50 may be included in one or more sections of the engine 20 other than the fan section 28 as well as in various turbine engines other than that described above. A person of skill in the art will also recognize the rotor assembly 50 may be included in various types of rotational equipment other than a turbine engine. The present invention therefore is not limited to any particular types or configurations of rotational equipment.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A rotor assembly, comprising:

a rotor disk including a slot;

a rotor blade including a blade root arranged within the slot, the blade root including a root base segment and a pair of root side segments, wherein the root base segment is laterally separated from the rotor disk by the root side segments; and a root spacer arranged within the slot, the root spacer including a side surface that extends radially between an inner surface and an outer surface, wherein the side surface is approximately laterally aligned with an intersection between the root base segment and a first of the root side segments; and the outer surface engages the root base segment;

wherein the root spacer includes a spacer base segment and a spacer side segment;

wherein the spacer base segment is arranged radially between the root base segment and the rotor disk; and wherein the spacer side segment is arranged radially between a second of the root side segments and the rotor disk.

2. The rotor assembly of claim 1, wherein a gap, located adjacent the side surface, extends radially between the first of the root side segments and the rotor disk.

3. The rotor assembly of claim 1, wherein the spacer base segment includes a portion of the outer surface having a substantially flat cross-sectional geometry.

4. The rotor assembly of claim 3, wherein the slot extends radially into the rotor disk from an opening with a first lateral width;

the portion of the outer surface has a second lateral width; and the second lateral width is between about 80 and about 110 percent of the first lateral width.

5. The rotor assembly of claim 1, wherein the rotor blade comprises a turbine engine fan blade.

6. The rotor assembly of claim 1, wherein the slot is one of a plurality of slots that extend longitudinally into the rotor disk;

the rotor blade is one of a plurality of rotor blades that are arranged circumferentially around an axis, and each of the rotor blades includes a respective blade root that is arranged within a respective one of the slots; and the root spacer is one of a plurality of root spacers, and each of the root spacers is arranged within a respective one of the slots between the rotor disk and a respective one of the blade roots.

7. A rotor assembly, comprising:

a rotor disk including a slot;

a rotor blade including a blade root arranged within the slot, the blade root including a root base segment and a pair of root side segments, wherein the root side segments extend laterally between and laterally separate the root base segment and the rotor disk; and a root spacer arranged within the slot, the root spacer including a side surface that extends radially between an inner surface and an outer surface that engages the root base segment;

wherein a gap, located adjacent the side surface, extends radially between a first of the root side segments and the rotor disk;

wherein the root spacer includes a spacer base segment and a spacer side segment;

wherein the spacer base segment is arranged radially between the root base segment and the rotor disk; and wherein the spacer side segment is arranged radially between a second of the root side segments and the rotor disk.

8. The rotor assembly of claim 7, wherein the side surface is approximately laterally aligned with an intersection between the root base segment and the first of the root side segments.

9. The rotor assembly of claim 7, wherein the side surface comprises a first side surface, and the root spacer further includes a second side surface that extends radially between the inner surface and the outer surface; and a gap, located adjacent the second side surface, extends radially between a second of the root side segments and the rotor disk.

10. The rotor assembly of claim 9, wherein the outer surface has a substantially flat cross-sectional geometry.

11. The rotor assembly of claim 9, wherein the slot extends radially into the rotor disk from an opening with a first lateral width;

the root spacer has a second lateral width that extends between the first and the second side surfaces; and the second lateral width is between about 80 and about 110 percent of the first lateral width.

12. A turbine engine, comprising:

a fan section, a compressor section, a combustor section and a turbine section arranged along an axis, the fan section including a rotor disk, a fan blade and a root spacer;

the rotor disk including a slot;

the fan blade including a blade root arranged within the slot, the blade root including a root base segment and a pair of root side segments, wherein the root base segment is laterally separated from the rotor disk by the root side segments; and the root spacer arranged within the slot, the root spacer including a side surface that extends radially between an inner surface and an outer surface, wherein the side surface is approximately laterally aligned with an intersection between the root base segment and a first of the root side segments; and the outer surface engages the root base segment;

wherein the root spacer includes a spacer base segment and a spacer side segment;

wherein the spacer base segment is arranged radially between the root base segment and the rotor disk; and wherein the spacer side segment is arranged radially between a second of the root side segments and the rotor disk.

13. The turbine engine of claim 12, wherein a gap, located adjacent the side surface, extends radially between the first of the root side segments and the rotor disk.

* * * * *